US005906173A

United States Patent [19]

Day, Jr. et al.

[11] Patent Number: 5,906,173

[45] Date of Patent: May 25, 1999

[54] ANCHOR LINE SHOCK ABSORBER

[76] Inventors: Charlie E Day, Jr., 2808 W. 12th St., Panama City, Fla. 32401; David B. Raulerson, P.O. Box 15055, Panama City, Fla. 32406

[21] Appl. No.: 09/095,437

[22] Filed: Jun. 10, 1998

[51] Int. Cl.[6] ..... B63B 21/24

[52] U.S. Cl. ..... 114/294; 114/215

[58] Field of Search ..... 114/294, 297, 114/298, 299, 300, 301, 303, 304, 213–215

[56] References Cited

U.S. PATENT DOCUMENTS

| | | | |
|---|---|---|---|
| 730,009 | 6/1903 | Duncanson | 114/294 |
| 3,518,957 | 7/1970 | George | 114/297 |
| 4,955,309 | 9/1990 | Ciccone | 114/230 |
| 5,307,753 | 5/1994 | Besonen | 114/230 |
| 5,333,845 | 8/1994 | Seiichi | 267/711 |
| 5,524,566 | 6/1996 | Rapa | 114/230 |

OTHER PUBLICATIONS

Deckhand ™ Instruction Manual May 1988 Johnson World-Wide Asso.

Letter Apr. 14, 1997 To: Johnson WorldWide Asso.

Letter Apr. 29, 1997 From: Johnson WorldWide Asso.

*Primary Examiner*—Ed L. Swinehart

[57] ABSTRACT

An improved and simplified anchor line shock absorber to protect an anchor line, the hoisting or lifting device gearing and motor attached thereto, from excessive shock forces. A tubular member, having a compression spring and located vertically, is arranged to fit within (a prior art) an anchor (shell) to absorb the shock forces. A (prior art) lifting line is attached to the terminal end of the spring assembly located within (the) an anchor. (shell.) This arrangement provides for free retrieval of the lifting line through and around guides, fair-leads, spools and drums when retrieved (by mechanical means.) mechanically.

1 Claim, 4 Drawing Sheets

ANCHOR LINE SHOCK ABSORBER

BACKGROUND

1. Field of Invention

This invention relates to Marine and Fishing Equipment and more particular to boat anchor line shock absorbing and cushioning.

2. Prior Art

Small boat anchors have, traditionally, been lowered and retrieved by hand or a hand operated winch. This worked well but was very slow and laborious. The hand operated winch gave way to power operated means, electric, hydraulic and such.

A means of absorbing the shock loading of the line and the resulting shock loading it imposed on the hoisting means, was desirable. Also desirable was the cushioning of the line due to wave action caused by weather, passing boats, and the act of retrieving the anchor line. This is particularly true as the anchor reaches the top of its travel and is suddenly stopped at high speed. It was imperative that the anchor line be free of any encumbrance while being retrieved. The prior art will confirm this need.

A search of the relevant prior art revealed the following U.S. Patents; Ciconne, U.S. Pat. No. 4,955,309; Besonen, Sr.; U.S. Pat. No. 5,307,753; Seiichi, U.S. Pat. No. 5,333,845; and Ropa, U.S. Pat. No. 5,524,566; Johnson Worldwide Associates, letters and DeckHand™ parts list.

All of the cited patents employ the use of coiled springs, compression and tension, to absorb the shock loads imparted on the lines attached to an anchor but mostly to moored boats at dock. The complexity of the cited devices are, by nature, difficult and very expensive to manufacture for the intended purpose. Any device operating in the marine environment should be kept as simple as possible. The fewer the parts contained in the assembly the less chance of a malfunction.

Besonen teaches the multiple use of his device to moor boats as well as anchor them. FIG. 1 in his drawings depict a boat at anchor with his device attached between the anchor and the boat. Multiple lines are attached to the device in order to moor the boat as well.

The dual use of this arrangement is awkward at best with the ever present danger of becoming entangled in the extra line . Mechanical means of retrieval is not possible due to the device being located within the anchor line. It cannot pass through line guides or be wound on a spool. Seiichi teaches the use of air as well as spring action to provide the damping action. It is not suited or intended for use under water or in the marine environment.

Ciconne, Besonen and Ropa, in the prior art, teach installation of their devices in-line between the boat and the attaching point or anchor. It, thus, becomes very difficult to quickly throw a mooring line over a cleat or piling. This docking operation should be performed quickly and accurately.

OBJECTS AND ADVANTAGES

Accordingly, several objects and advantages of the present invention are:

(a.) To provide shock absorbing means for use in a mechanical anchor retrieval device or system.

(b.) To provide a means for installing the device totally within the anchor shell.

(c.) To provide a device that can be retrievably attached to the end of a line.

(d.) To provide shock absorbing means to a line while being retrieved through guides, fair leads and rollers. Also, the ability to wind the line over spools, drums and such while being retrieved.

(e.) To provide shock protection to the plastic gears and motors in the hoisting means.

(f.) To provide a corrosion resistant device to be used in a marine or under water application.

(g.) To provide a simple design and reduce the quantity of moving parts.

(h.) To provide a device whose parts are readily available at most hardware and building supply centers.

(i.) To provide a device simple enough for the average layman to install with minimum tools and effort.

(j.) To provide a fail safe assembly in case of failure to any member except the anchor line.

Further objects and advantages will become apparent from the drawings and descriptions including the simplicity of construction and installation.

DRAWING FIGURES

REFERENCE NUMERALS IN THE DRAWINGS

Figure 1:
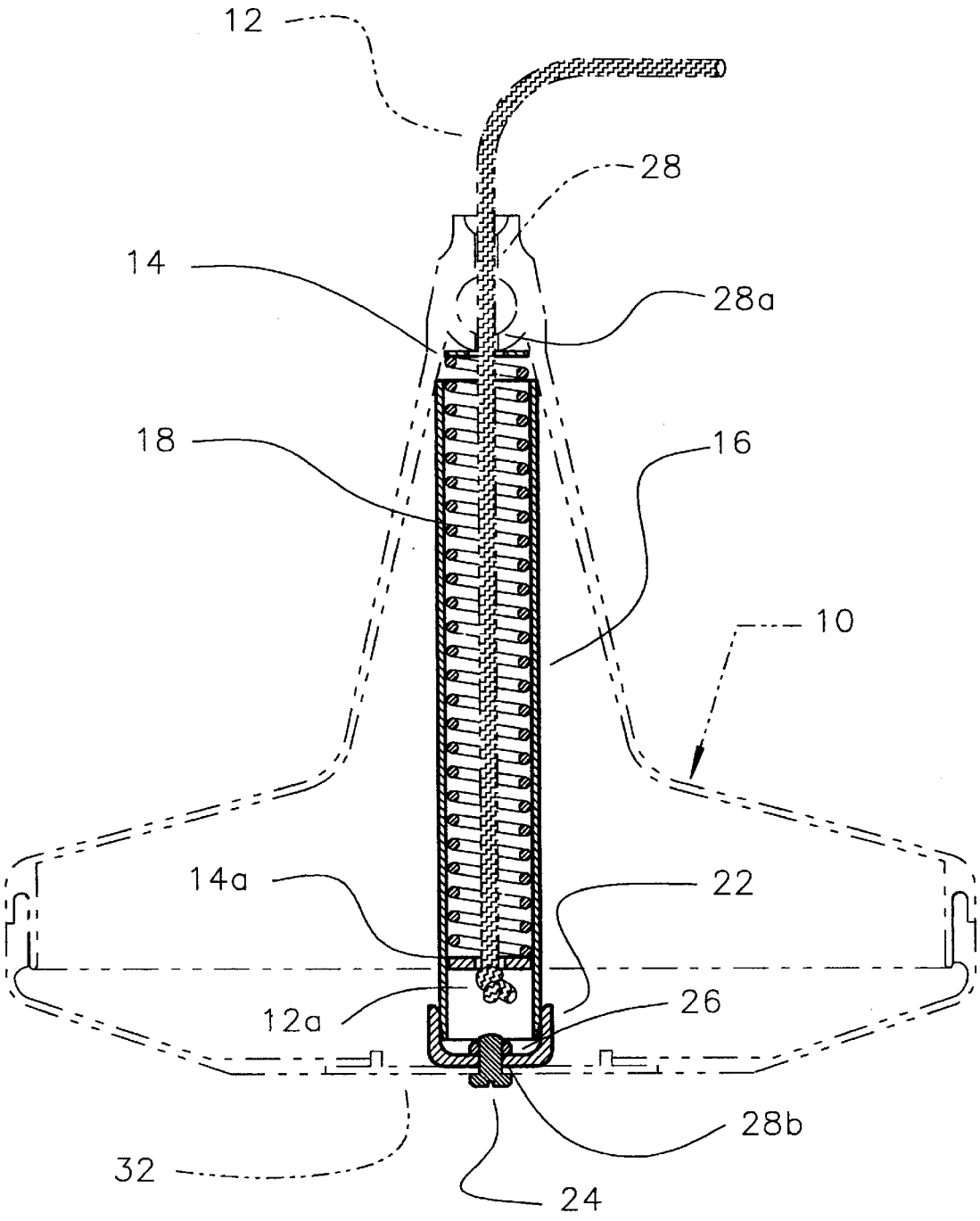
FIG. 1 shows a sectional view of the main embodiment within the anchor shell.

In the drawings closely related reference numerals have the same numbers but different alphabetic suffixes.

10 anchor shell (prior art)
12 anchor line (prior art)
12*a* line knot
14 thrust washer
14*a* thrust washer
16 spring housing
16*a* alternate spring housing
18 compression spring
20 alternate thrust gauge
22 spring housing cap
22*a* alternate spring housing cap
24 screw
26 nut
28 hole (prior art)
28*a* hole
28*b* hole
28*c* alternate vertical hole
28*d* alternate vertical hole
30 alternate upper thrust cap
32 bottom plate (prior art)

SUMMARY OF THE INVENTION

The primary purpose of the present invention is to provide a cushioning or shock absorbing effect on an anchor line as it is being retrieved by electric means. This reduces the severe shock on the plastic gear in the hoisting mechanism of the Deck Hand™ anchor.

The present invention is totally enclosed, in its entirety, within the anchor shell of the Deck Hand™ anchor system.

The Deck Hand™ anchor is manufactured by Johnson Worldwide Asso. of Racine, Wis.

Further, the present invention, being installed at the farthest end of the anchor line, brings the added advantage of being retrievable through various guides and rollers. The line may be wound about spools and drums as well.

DESCRIPTION—MAIN EMBODIMENT—FIG. 1 TO 2

A typical embodiment of the present invention is shown in section in FIG. 1. The entire assembly is contained within an anchor shell 10 (prior art). Shell 10 has a diameter of approximately 8.2" and an overall height of approximately 6.75". Shell 10 is hollow and made of a plastic material capable of holding 16 to 18 lbs. of lead pellets for weight. An anchor line 12 (prior art), of approximately 0.188 dia., is furnished for attaching the hoisting mechanism (not shown) to shell 10.

To assemble the components within shell 10, line 12 is threaded through a hole 28 (prior art) and a hole 28*a*. Hole 28*a* must be drilled, using hole 28 as a guide, through the top of shell 10 and immediately below hole 28. Hole 28*a* must penetrate the plastic material into the cavity of shell 10. Hole 28 and hole 28*a* should be approximately 0.25" in diameter.

Pull line 12 completely through shell 10 for about 12" to 14". Turn shell 10 upside down with hole 28 and hole 28*a* now being on the bottom of shell 10. A thrust washer 14, fabricated from a rust resistant metal approximately 0.75" dia.×0.063" thick with a 0.313" hole in the center is threaded over line 12. Washer 14 is inserted in the neck cavity of shell 10 as shown in FIG. 1. A spring housing 16 is now threaded over line 12. Firmly press housing 16 vertically into the neck cavity of shell 10 as shown in FIG. 1. Housing 16 is commercially made of any of several plastic materials including type 135 PVC pipe. Housing 16 is 0.500" nominal i.d.×approximately 0.840" o.d. as manufactured by many commercial plastic extruders. Housing 16 is approximately 5.25" in length and slightly beveled on each end to facilitate insertion in shell 10 neck cavity.

Next in the assembly process, a compression spring 18 is slipped over line 12 and dropped into housing 16 as detailed in FIG. 1. Spring 18 is made of corrosion resistant materials including, but not limited to, stainless steel, beryllium copper or phosphor bronze as manufactured by Ace Spring Wire and Form Co., inc. of MCKees Rocks, Pa. 15136.

Finally, a thrust washer 14*a* manufactured from material similar to washer 14, having a 0.680" o.d.×0.25" i.d.×0.063" thick, is placed over line 12. A line knot 12*a* is firmly tied in the end of line 12. For safety, 3 or 4 drops of a fast drying waterproof glue should be applied to knot 12*a*.

Figure 2:
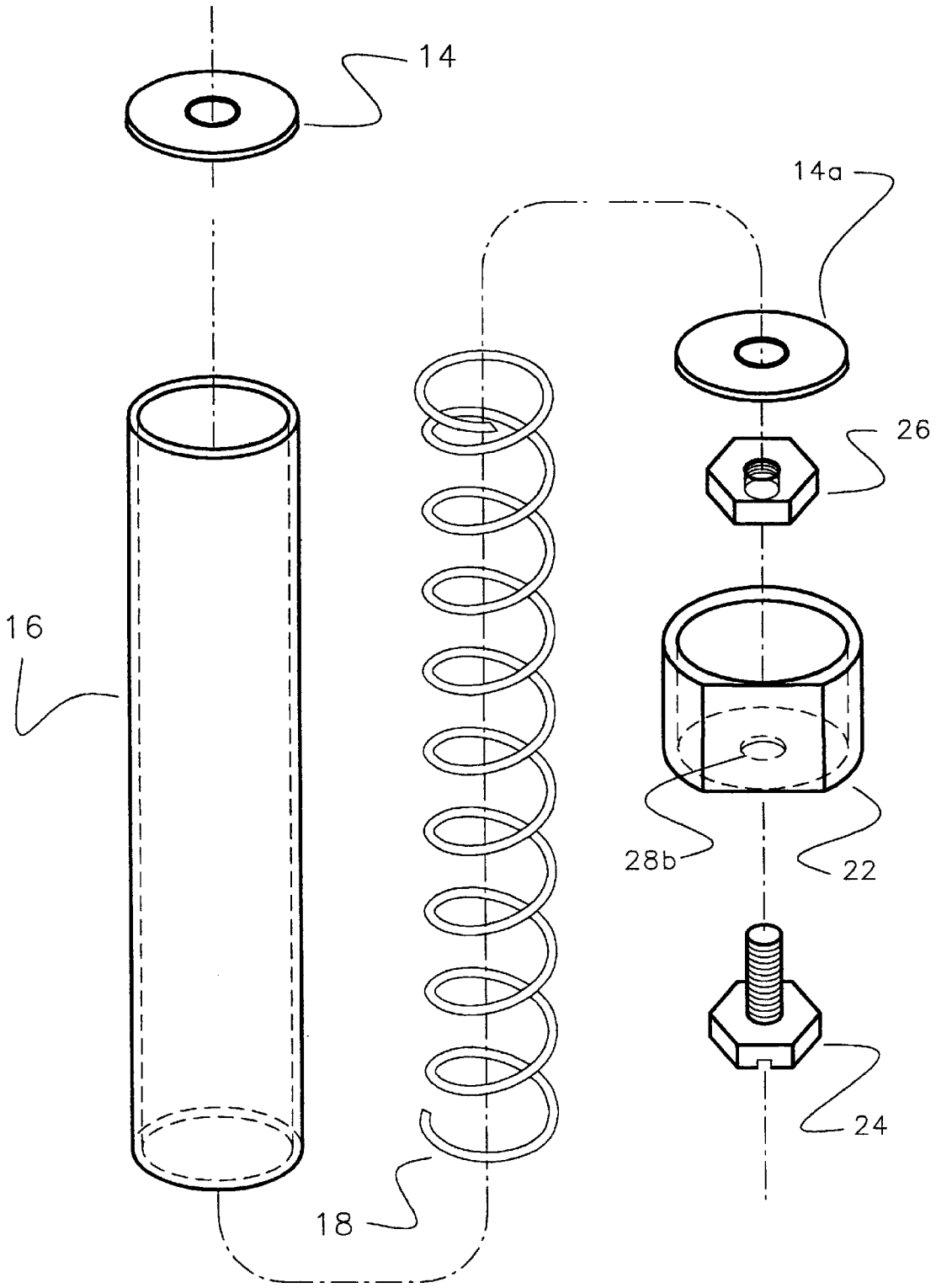
FIG. 2 shows an exploded view of the working members of the main embodiment.

With shell 10 still in the bottom up position, pull line 12 back through the neck of shell 10. The entire assembly, washer 14, spring 18, washer 14*a*, line 12 and knot 12*a* should be completely within the cavity of housing 16. The exploded view in FIG. 2 illustrates the entire assembly sequence as described.

The cavity of shell 10 is now ready to be filled with lead pellets to complete the assembly. A gallon can or bucket makes a great stand to hold shell 10. Place a cotton ball, paper towel or masking tape temporarily over the open end of housing 16 to ensure that no lead pellets get inside. Fill the cavity of shell 10 level full of lead pellets. Shake shell 10 at intervals to settle the pellets to eliminate voids.

With shell 10 filled with pellets, start the bottom closing steps. Using a spring housing cap 22 as a template, place the flat side of cap 22 along the flat raised surface of a bottom plate 32 (prior art). Center cap 22 along the flat side of plate 32. With cap 22 as a guide, drill a hole 28*b* through cap 22 and plate 32 to receive a screw 24 and a nut 26. Fasten cap 22 to plate 32 using screw 24 and nut 26. Screw 24 is a stock 10-32 stainless screw with nut 26 to match. Tighten nut 26 securely but do not over tighten. A drop of waterproof glue between plate 32 and cap 22 is desirable. Remove the temporary closure from housing 16.

Close the assembly by placing plate 32, with cap 22 attached, over the end of housing 16. Fit plate 32 in the opening provided in shell 10. Using 4 stainless screws provided, (prior art), fasten plate 32 to shell 10 through the pre-drilled holes provided in plate 32 and shell 10. The unit, with the anchor line shock absorber in place, may be turned upright and is now ready for use.

Operation—Main Embodiment—FIG. 1 to 2

The manner of using the anchor line shock absorber is nearly automatic. When force from the hoisting means is applied to line 12, the resulting upward force is resisted by knot 12*a*. This forces washer 14*a* to move upward compressing spring 18. When spring 18 begins to compress, it is restrained by washer 14 thereby lifting the anchor or other weight. Spring 18 is compressed only enough to lift the anchor but without imparting any shock loading to line 12 or any part of the lifting device or gearing. Housing 16 acts to prevent spring 18 from buckling and becoming misaligned.

When shell 10 is hoisted and reaches its topmost position it begins to change its vertical direction to a horizontal direction. The extra shock load is now further absorbed by spring 18. The maximum shock load occurs when the weighted shell 10 reaches the end of its upward travel and is suddenly stopped in its socket within the lifting means. At this point spring 18 again compresses further to absorb this solid lockup shock between shell 10, line 12 and the lifting motor, line spool, and its connective plastic gearing.

This shock absorbing action prevents damaging loads being applied to the lifting device at any stage in its upward travel. Wave action from passing boats or wind is also prevented from shocking line 12, or any lifting mechanism attached. Absorbing the sudden loads imparted to line 12 and the weighted shell 10 prevents damaging shocks to the hoisting means. Line 12 may be retrieved through rollers, fair leads, spools and other means since the present invention is attached, at its farthest end, to the anchor or the weight being lifted.

DESCRIPTION—ALTERNATIVE EMBODIMENT—FIG. 3 TO 4

Figure 3:
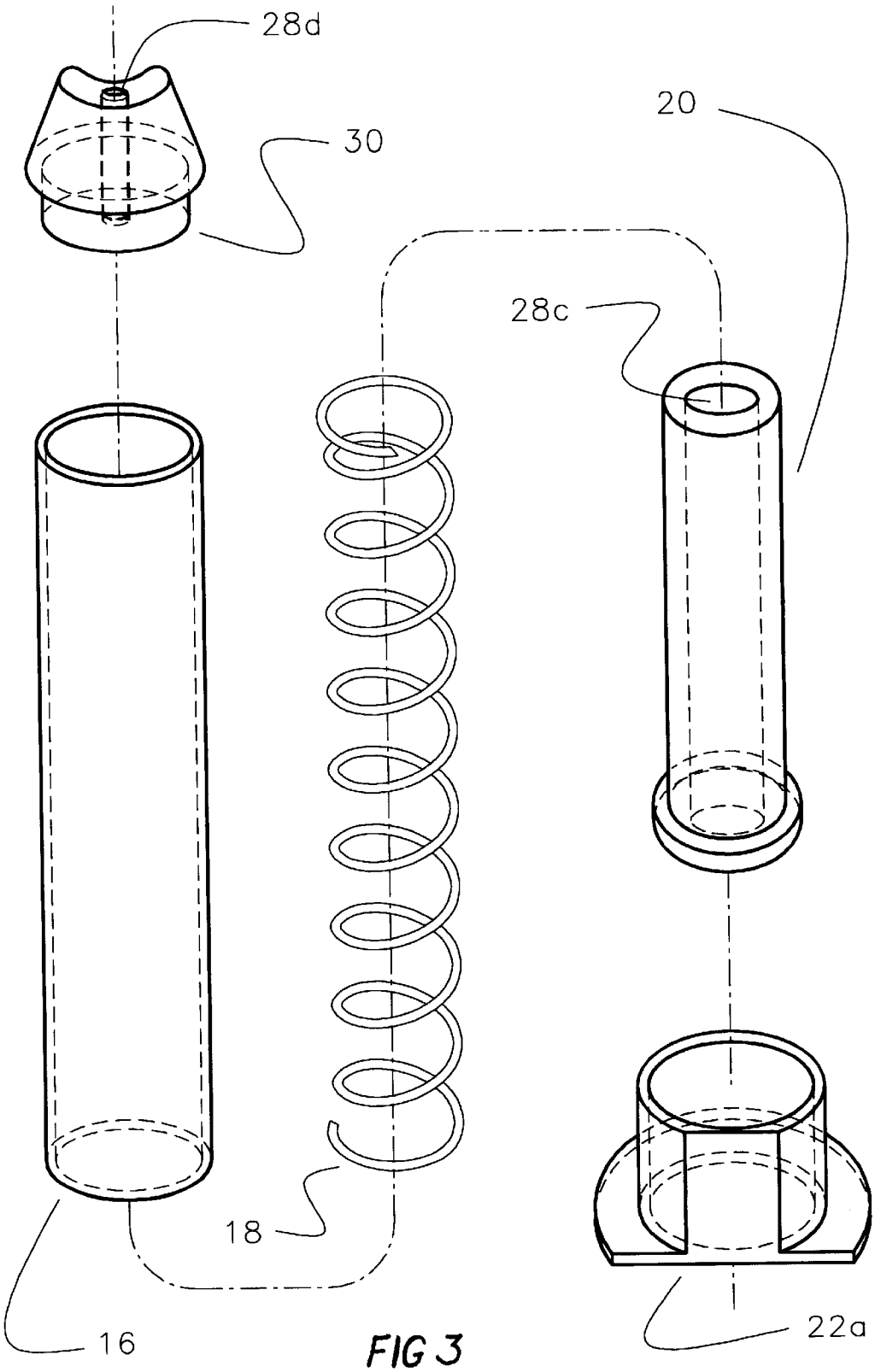
FIG. 3 shows an exploded view of an alternate embodiment.

FIG. 3 shows 3 alternative embodiments of the present invention. These may be used interchangeably with their equivalent components shown in FIG. 1, 2. An alternate thrust gauge 20 may be composed of any hard plastic or corrosion resistant metal. Gauge 20 is approximately 2.5" in overall length with the small diameter approximately 0.500" to fit within spring 18. The larger base of approximately 0.690" dia. fits within housing 16. An alternate vertical hole 28*c*, approximately 0.25" dia., is drilled longitudinally through the center. Gauge 20 may be used in lieu of washer 14*a*.

An alternate spring housing cap 22*a*, as shown in FIG. 3, composed of a plastic material such as PVC, is approximately 0.625" high×1.75" o.d. with the bottom flange approximately 0.125" thick. Cap 22*a* may be used in lieu of cap 22.

An alternate upper thrust cap 30, composed of a plastic material such as PVC, is approximately 0.840" o.d.×0.75.

Cap 30 is sized to fit within the upper neck cavity of shell 10. The small end is sized to fit into housing 16. An alternate vertical hole 28*d,* approximately 0.25" dia., is drilled longitudinally through cap 30. Hole 28*d* allows passage of line 12 as it compresses and decompresses spring 18. Cap 30 may be used in lieu of washer 14.

The advantage of the assembly shown in FIG. 3 is to ensure that no foreign objects get into housing 16. Cap 30 seals the upper end of housing 16 and cap 22*a* seals the bottom of housing 16. Gauge 20 has a dual function. It performs the duty of washer 14*a* and also stops spring 18 from collapsing to the solid position. This keeps spring 18 from taking a permanent set which would decrease the active travel height of spring 18. The alternate embodiment shown in FIG. 3 is more expensive to manufacture.

Figure 4:
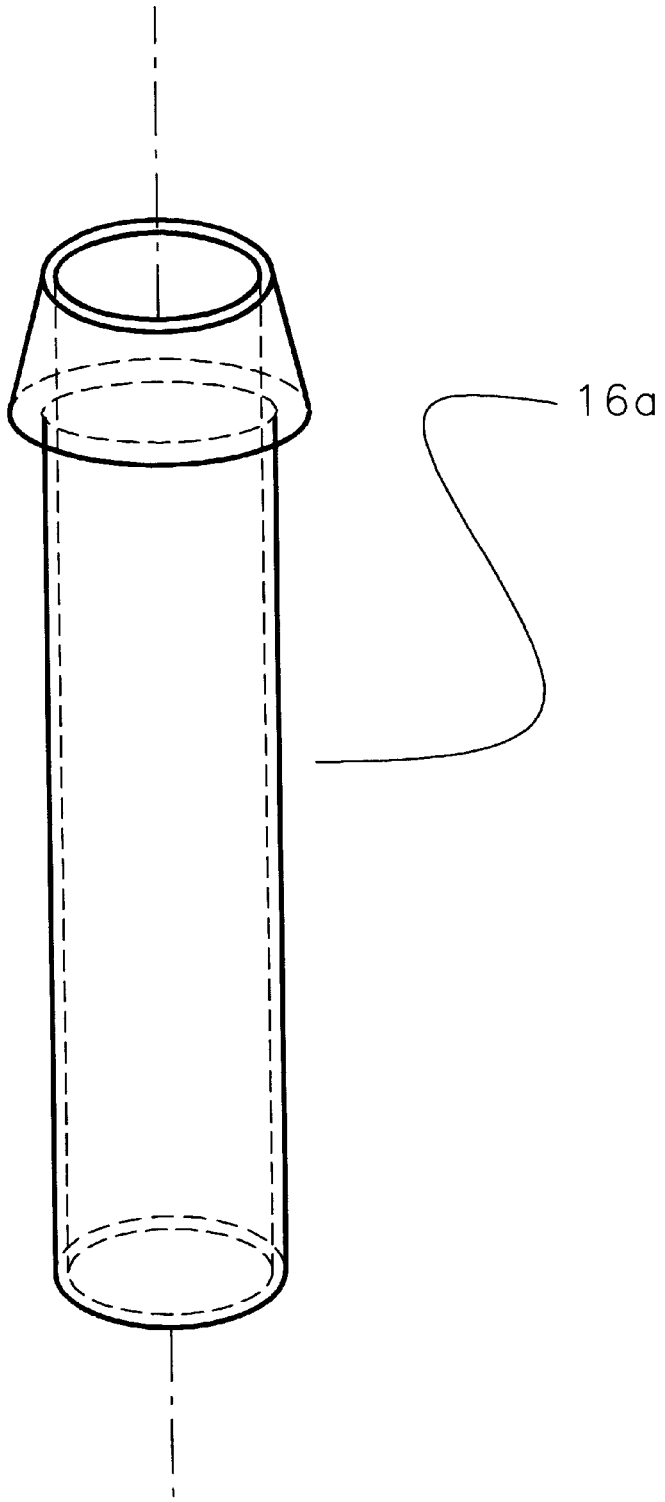
FIG. 4 shows a view of an alternate spring housing.

FIG. 4 shows a view of an alternate spring housing 16*a*. Shell 10 is shown in detail in FIG. 1. Housing 16*a* may be used interchangeably with housing 16 as shown in FIG. 1, 2, 3. Housing 16*a* is made of the same plastic material (PVC) as that shown in previous illustrations. The difference in housing 16*a* is the enlarged tapered area on the upper end. This tapered area is approximately 0.25" larger than the outside of housing 16 and approximately 0.75" in length. Housing 16*a* would be more expensive to produce than housing 16.

Operation—Alternate Embodiment—FIG. 3 to 4

The basic manner of operation of the anchor line shock absorber in FIG. 3 is identical to the operation of FIG. 1, 2. The important differences are as follows: The larger flange of Gauge 20 provides upward force on spring 18 in lieu of washer 14*a*. Gauge 20 also limits the maximum amount that spring 18 can compress before it becomes solid. The smaller end of gauge 20 contacts cap 30, or washer 14 if used as shown in the FIG. 2, and effectively stops spring 18 before it can reach a solid height. This prevents spring 18 from possibly taking a permanent set in the spring material thereby reducing the effective free length.

Cap 30 further seals the upper end of housing 16 to prevent contamination in housing 16 and within spring 18 working area. Cap 22*a* may be used to replace cap 22 as shown in FIG. 1, 2. The advantage of cap 22*a* over cap 22 is the elimination of screw 24, nut 26, and the drilling of hole 28*b*.

Housing 16*a,* shown in FIG. 4, may be used in lieu of housing 16 and its method of operation is the same. The main advantage of housing 16*a* is the ease of installation. When housing 16*a* is installed within the neck area of shell 10, it is self aligning. Also, when shell 10 is turned upside down for maintenance, the enlarged tapered area of housing 16*a* will resist moving out of position. The lead pellets contained within shell 10 will lock housing 16*a* in position whereby the lead pellets will not intrude within the cavity of housing 16*a*.

CONCLUSIONS, RAMIFICATIONS AND SCOPE

Accordingly, the reader will see that the Anchor Line Shock Absorber of the present invention may easily be installed within the prior art anchor shell. It can be readily built and assembled from stock components with a minimum of tools and skill. Furthermore, it has additional advantage in that;

- it can be attached to the end of the anchor line.
- it does not interfere with the retrieval of the anchor line.
- it allows the retrieved line to pass through guides, rollers, and fair leads.
- it allows the line to be retrieved over spools and drums or any stowage device as required by the hoisting means.
- it will protect the hoisting means from all damaging shocks encountered during line retrieval.
- it will protect all attached equipment from shocks due to wind and waves while at anchor.
- it cannot be seen by the casual observer after installation within the anchor shell.
- it provides a fail safe assembly in case of failure of a member within the device.

Although the description above contains many specificities, these should not be construed as limiting the scope of the invention but as merely providing illustrations of some of the present preferred embodiments of this invention. For example, the spring housing and spring size may have other configurations to meet the requirements of other anchor shapes and materials. Any weight or device being hoisted, needing shock protection for the line and hoisting means, may be accommodated by upward sizing of the components and strength of materials.

Thus, the scope of the invention should be determined by the appended claims and their legal equivalents rather than by the examples given.

We claim:

1. An anchor line shock absorber assembly, adapted to for insertion within an anchor body, for absorbing shock to anchor lines and hoisting means while deployed and during retrieval, comprising:

(a) a tubular member of sufficient length and diameter to form a housing to receive a shock absorbing means (c) a plurality of thin, circular, planar surfaces adjoining each end of said shock absorbing means (d) a hole in the center of each planar surface for pass passage of a a flexible lifting line through said shock absorbing means and said planar surfaces (e) a knot being tied in said lifting line below a lowermost said planar surface to secure said lifting line to said shock absorbing means (h) said shock absorber assembly allowing said lifting line free passage to and from said hoisting means whereby, when said shock absorber assembly is installed in an anchor body, said shock absorber assembly preventing damage to said anchor line and said hoisting means, and adapted for providing continuous attachment of said anchor line to the anchor body in the event of failure of a portion of said shock absorber assembly.

* * * * *